US006198694B1

(12) United States Patent
Kröling et al.

(10) Patent No.: US 6,198,694 B1
(45) Date of Patent: Mar. 6, 2001

(54) METHOD AND DEVICE FOR PROJECTILE MEASUREMENTS

(75) Inventors: Olle Kröling, Lund; Håkan Appelgren, Föreningsgatan 5, S-254 38 Helsingborg, both of (SE)

(73) Assignee: Håkan Appelgren, Helsingborg (SE)

( * ) Notice: Subject to any disclaimer, the term of this patent is extended or adjusted under 35 U.S.C. 154(b) by 0 days.

(21) Appl. No.: 09/155,143

(22) PCT Filed: Mar. 27, 1997

(86) PCT No.: PCT/SE97/00547

§ 371 Date: Feb. 26, 1999

§ 102(e) Date: Feb. 26, 1999

(87) PCT Pub. No.: WO97/37194

PCT Pub. Date: Oct. 9, 1997

(30) Foreign Application Priority Data

Mar. 29, 1996 (SE) ..... 9601248
Dec. 20, 1996 (SE) ..... 9604768

(51) Int. Cl.[7] ..... G01S 3/808; F41J 5/06
(52) U.S. Cl. ..... 367/127
(58) Field of Search ..... 367/127, 906, 367/129; 273/372; 235/400

(56) References Cited

U.S. PATENT DOCUMENTS

| | | | | |
|---|---|---|---|---|
| 3,445,808 | | 5/1969 | Johnson . | |
| 4,261,579 | * | 4/1981 | Bowyer et al. | 367/906 |
| 4,333,170 | | 6/1982 | Mathews et al. . | |
| 4,505,481 | * | 3/1985 | Knight | 273/372 |
| 4,805,159 | | 2/1989 | Negendank et al. . | |
| 5,095,433 | | 3/1992 | Botarelli et al. . | |
| 5,241,518 | | 8/1993 | McNelis et al. . | |
| 5,247,488 | | 9/1993 | Borberg et al. . | |
| 5,258,962 | | 11/1993 | Karlsen . | |
| 5,349,853 | | 9/1994 | Oehler . | |

FOREIGN PATENT DOCUMENTS

| | | |
|---|---|---|
| 4106040 | 8/1992 | (DE) . |
| 157397 | 10/1985 | (EP) . |
| 259428 | 6/1991 | (EP) . |
| 439985 | 7/1985 | (SE) . |
| 467550 | 1/1990 | (SE) . |

* cited by examiner

*Primary Examiner*—Daniel T. Pihulic
(74) *Attorney, Agent, or Firm*—James Ray & Associates

(57) ABSTRACT

According to a method and a device for deciding relative to a chosen reference system, and without contact, the position, direction or speed—or any combination thereof—for a projectile (10) in its flight through a gas towards a giver target (30), the position of the projectile in a first plane (35) is decided at a certain distance from the target by means of at least three acoustic sensors (S1, S2, S3) arranged in a vicinity of the plane. Acoustic sound waves, emanating from a turbulent gas volume (13, 14, 15) extending essentially straight behind the projectile (10), and/or emanating from a wake or monopole (12, 13) existing essentially straight behind the projectile, are received by means of the acoustic sensors (S1, S2, S3). Time differences for the arrival of the acoustic sound waves to the respective acoustic sensors are measured. The projectile position (x, y; x1, y1) in the first plane is calculated from the time differences. The hit point (25) of the projectile in a target plane (31) through the target (30) is decided with the help of the calculated projectile position in the first plane.

20 Claims, 3 Drawing Sheets

METHOD AND DEVICE FOR PROJECTILE MEASUREMENTS

TECHNICAL FIELD

This invention relates to a method and a device for deciding, relative to a chosen reference system and without contact, the position, direction or speed, or any combination thereof, for a projectile during its flight through a gas towards a given target, where the position of the projectile, in at least one plane, is determined at a certain distance from the target by means of at least three acoustic sensors arranged in the vicinity of said plane.

DESCRIPTION OF THE PRIOR ART

A common application in the above mentioned technical field is target shooting with small-arms, e.g. rifles or pistols, at some form of target. It can for instance be a conventional target practising panel with concentric rings, where scores are given depending on the bullet hit point relative to the target panel centre. A common form of military target shooting is shooting against so called pop-up targets, i.e. target panels picturing e.g. an enemy soldier, which at irregular time intervals are raised in the terrain in front of the shooter. The shooter's task is, as quickly as possible, to give fire against the said target, and if the shooter hits the target, the target drops down.

There are different ways to indicate hits in a target shooting system as described above. The simplest is to simply use conventional target panels of wood, cardboard or similar material, which are thin enough to be penetrated by a bullet. The hit point of the bullet in the target is in this way visible to the naked eye, at least at close distance.

Another known way to detect the hit point of the bullet is to use acoustic sensors, which are fixed to the target panel and which are arranged to detect the vibrations or sound waves, which are generated in the hit point and propagate concentrically in the target panel around the hit point. In the American patent publication U.S. Pat. No. 5,095,433 a target shooting system is shown, wherein a range of vibration sensors are arranged at different places on the target panel with known relative distances. The vibration sensors are arranged to detect vibrations or sound waves in the target panel, when a bullet hits the latter, and supply electric signals to a microprocessor as a result thereof. By registering the time differences for the hit signals from the respective sensor the microprocessor can, by triangulation, decide the hit point of the bullet in the target panel. The result is presented by a synthetic voice announcing the result through a loud-speaker. Systems of this nature have the drawback that since the sensors are fixed in connection with the target panel, they suffer a great risk of, sooner or later, being hit by an incoming bullet resulting in destruction of the hit sensors.

In a different target shooting system non-contact detection of the position of the projectile is used. Here, non-contact detection means that the sensors used for detection are arranged at a certain distance from the target panel, wherein the risk for destruction through a bullet hit is considerably reduced or even completely eliminated. A number of different systems for such non-contact detection with acoustic sensors are known today through e.g. the European patent publications EP-B1-0 259 428 and EP-B1-0 157 397, the American patent publications U.S. Pat. Nos. 5,247,488 and 5,349,853, the Swedish patent publication SE-B-467 550 and the German patent publication DE-C2-41 06 040. In SE-B-439 985 a system for deciding the position of high-speed projectiles is shown, wherein the passage of the projectile through two parallel planes is detected with three acoustic transducers for each plane. All of these inventions relate to the detection of so called supersonic projectiles, i.e. such projectiles, which travel faster than the sound in the same medium (normally air). Such projectiles can e.g. be anti-aircraft projectiles for shooting against towed air target, bullets from high-speed small-arms, etc.

Common to the above-mentioned inventions is that they all use the so called Mach cone, which is generated around a supersonic projectile. The Mach cone is a pressure or bow wave (sometimes called sound bang), which is generated when a supersonic projectile "overtakes" its own sound, whereby a strong conical pressure change is generated around the projectile. The cone angle of the Mach cone depends on the so called Mach index, M, which is defined as the quotient between the speed of the projectile and the speed of sound. When the sound bang reaches the sensors, it is converted to a rapid, almost N-shaped electrical pulse, which can be used in analogy with the above to decide the time differences between the electrical signals and thereafter, e.g. by triangulation, decide the position of the projectile in some plane. Certain systems of this kind use other acoustic information as well, such as hit sound or firing sound.

However, not all projectiles travel faster than sound ($M>1$). Many simpler small-arms fire bullets, which travel slower than sound. For pistols with 9 mm ammunition a bullet speed of around 300 m/s ($M\approx0,9$) may appear, and the corresponding speed for 5,6 mm ammunition may be 250 m/s ($M\approx0,7$). For 0.22 rifles a bullet speed as low as 140 m/s ($M\approx0,4$) can be found. Since a sub-sonic projectile does not create a Mach cone or a sound bang, the above-mentioned systems are not applicable for the detection of such projectiles.

SUMMARY OF THE INVENTION

The object of this invention is to make possible non-contact measurement of position, direction or speed for a projectile, e.g. a bullet, which is fired at a target panel from small-arms, without using neither firing sound nor target hit sound for the measurement. In particular, this invention is directed towards making measurements possible as above for such projectiles, that travel at a speed, which is below the speed of sound in the same gaseous medium ($M<1$), and that do not create any sound bang.

The object is achieved by a method and a device with the features, which are to be found in the characterising part of the enclosed independent patent claims. Preferred embodiments of the invention are defined by the appended sub-claims.

BRIEF DESCRIPTION OF THE DRAWINGS

The invention will be described in more detailed in the following referring to the enclosed drawings, in which.

DETAILED DESCRIPTION OF THE INVENTION

Below follows first an analysis of the mechanisms, which generate measurable sound from a subsonic projectile. The analysis does not claim to be complete in all theoretical aspects, but it explains the essential parts of the sound generation and therefore gives a good basis for the rest of the description. After this a test set-up is described, which illustrates the detecting principle, and finally preferred and alternative embodiments of the invention are described.

a) Theoretic analysis

Figure 1:
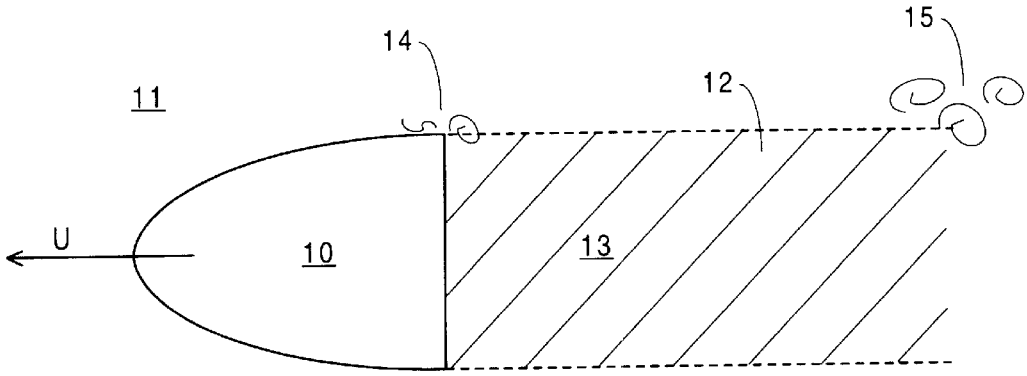
FIG. 1 is a schematic side view of sound generation from a projectile.

In FIG. 1 there is shown in a schematic way a projectile 10, which travels with a speed U through a surrounding medium 11, e.g. air. The projectile 10 is e.g. a rifle bullet. Since the speed U of the projectile is below the speed of sound c, i.e. the Mach index M<1, where M=U/c, there is no sound bang or conical bow-wave around the projectile.

Generally speaking the acoustic emission (sound generation) of a projectile can be seen as consisting of thee main parts; a firing part, an aeroacoustic part, caused by flow phenomena around the projectile during its flight, and a touchdown—or target hit part. According to the above, this invention uses neither firing sound nor target hit sound, and the analysis is therefore focused on the aeroacoustic part.

For a subsonic projectile this part contains three contributions according to the so called Lighthill's theory for aeroacoustic sound generation (see e.g. Mats Åbom, "Kompendium i strömningsteknik", Institutionen för teknisk akustik, KTH, Stockholm, 1991). The first contribution is a so called acoustic monopole 12, which develops in the so called wake 13, which is generated essentially straight behind the projectile 10. A so called dipole contribution 14 is caused by the instationary whirl generation, which develops at the rear edge of the projectile. Finally a so called quadrupole contribution 15 is generated by the free turbulence, which is developed in the wake 13 behind the projectile 10.

The monopole contribution will be studied first. According to the above-mentioned reference the sound pressure p from a monopole source in linear travel can be expressed as $$p(h,t)=\frac{\partial}{\partial t}\left\{\frac{\rho_0 Q}{4\pi\ R\sqrt{1-M^2\sin^2\Theta}}\right\} \tag{1}$$

where $\rho_0$ is the density for the given medium at rest, Q is the volume flow of the monopole, M is the Mach index, t is the time, R is the distance between the projectile and the point of measurement, and sin (Θ)=h/R, where h is the distance between the projectile and the point of measurement at t=0.

The volume flow Q is the volume addition per time unit in the wake 13, and if the wake has a cross sectional area A and the projectile travels at a speed U, then $$Q=A\cdot U \tag{2}$$

From (1) and (2) and geometrical re-writing follows $$p=\frac{\rho_0 UA}{4\pi}\frac{\partial}{\partial t}\left\{\frac{1}{\sqrt{(Ut)^2+(1-M^2)h^2}}\right\}=-\frac{\rho_0 U^3 At}{4\pi\{(Ut)^2+(1-M^2)h^2\}^{3/2}}. \tag{3}$$

If the sound pressure p is plotted as a function of time t with typical values on A, $\rho_o$, U and c, then an N-formed curve is obtained, which shows that the sound pressure p is several tenths of Pa at a distance h=1 m and several hundredths of Pa at h=3 m. This pressure can be seen as a pressure wave, which propagates radially from the wake 13 and moves with the speed of sound. This means i.a. that the pressure wave will be in front of a subsonic projectile but behind a supersonic projectile.

The dipole and quadrupole contributions are according to the above caused by the turbulence, which is created behind the projectile. A certain part $\eta_{ak}$ of the energy $W_{pro}$, which is converted to turbulence, is transformed into acoustic energy $W_{ak}=\eta_{ak}\cdot W_{pro}$, which is emitted in the form of sound waves. $W_{pro}$ can be calculated with the help of the air resistance coefficient $c_d$, defined as $$F_d=c_d\cdot A\cdot\frac{\rho_0 U^2}{2}, \tag{4}$$

where $F_d$ is the air resistance force acting on the projectile 10. This gives $$w_{pro}=F_d\cdot U=\frac{c_d\rho_0 AU^3}{2}. \tag{5}$$

$C_d$ can be estimated by measurements. For a certain type of projectile one can for instance find that $C_d$=0.21. As regards $\eta_{ak}$ one can find in literature (see e.g. Beranek, "Noise and Vibration Control", McGraw-Hill, 1971) that $\eta_{ak}\approx 1\cdot 10^{-5}$ at U=200–250 m/s for the quadrupole part. The dipole part divided by the quadrupole part is $1/M^2$, which in this case approximately corresponds to a factor of 2. It is therefore reasonable to assume that $\eta_{ak}$ lies in the interval $[10^{-5}, 10^{-4}]$.

The sound pressure at a certain distance h from the projectile 10 can, if the emission is assumed to be spherical, be expressed as $$\langle\tilde{p}^2\rangle=\rho_0 c\frac{W_{ok}}{4\pi h^2}=\{ekv.\ (4)\}=\frac{\rho_0 c\eta_{ok}W_{pro}}{4\pi h^2}, \tag{6}$$

where < > represents a mean value over a sphere and ~ represents a root-mean-square value. For a 9 mm projectile with $A=6{,}4\cdot 10^{-5}$ m$^2$ and $c_d$=0.21 equation (5) gives $W_{pro}$= 126 W for U=250 m/s, and $W_{pro}$=81 W for U=200 m/s. With the help of equation (6) the mean value of the sound pressure may then be calculated for different distances h from the projectile. The values U=250 m/s and h=2 m give a sound pressure mean value of 0,010–0,10 N$^2$/m$^2$, U=250 m/s and h=3 m give 0,0046–0,046 N$^2$/m$^2$, U=200 m/s and h=2 m give 0,0065–0,065 N$^2$/m$^2$ , and U=200 m/s and h=3 m give 0,0029–0,029 N$^2$/m$^2$.

Hence, sound generated from a subsonic projectile has such a power that it can be detected at several meters distance from the projectile. Below is briefly investigated the energy content at different frequencies for the sound, something which is of some importance for the resolution of the detection according to the invention described below.

The sound pressure p from the monopole contribution in formula (1) is changed from an under-pressure to an over-pressure, when the time goes from negative values to positive values. The pressure change happens during some milliseconds. In a known way a time function can be transformed into a frequency spectrum, and a well-known fact is, that the faster the time changes, the broader the frequency spectrum. In this case a typical change, when p goes from under-pressure to over-pressure, can be seen as a frequency spectrum with a fundamental frequency around 20 kHz. Hence, this means that the change can be detected in a frequency range, which is far above that which a human can hear, e.g. in the range around 40 kHz.

It is reasonable to assume, that the sound spectrum generated by the dipole and quadrupole contributions is a broadband spectrum with noise characteristics and that the harmonic content is larger than the sub-harmonic content (the spectrum is uneven). The spectrum should have a peak at the so called Strouhal frequency $f_{st}$ of the projectile (cf. the reference literature above), where $f_{st} \approx 0{,}2U/d$ and d is the cross-sectional area of the projectile. It can further be assumed that the amplitude envelope of the spectrum can be approximated by an exponential function. Hence the following function is considered:

$$v(t) = Ae^{-\alpha t}u(t)$$

which after Fourier transformation gives $$V(j\omega) = \int_0^\infty Ae^{-\alpha t}e^{j\omega t}dt = \frac{A}{\alpha + j\omega}$$

The power in the noise during a unit time is proportional to $$F_q = \frac{1}{\pi}\int_0^\infty |V(j\omega)|^2 d\omega$$

and the power in a specific frequency range is $$\Delta F_q = \frac{1}{\pi}\int_{\omega_1}^{\omega_2} |V(j\omega)|^2 d\omega$$

With $\alpha = \omega_{St} = 2\pi f_{St} = \omega_0$ the following relation between the power in the said frequency range and the total power is obtained:

$$\frac{\Delta F_q}{F_q} = \frac{2}{\pi}\left[\frac{1}{\omega_o}\tan^{-1}\frac{\omega}{\omega_o}\right]_{\omega_1}^{\omega_2} \quad (7)$$

The total power has been calculated before for the distance of 3 m, and with the help of formula (7) the available sound power in a supersonic sound range between 30 kHz and 50 kHz at a distance of 3 m is found to be approximately 40 dB (relative to 20 $\mu$Pa). Hence, it is shown that sound is generated from subsonic projectiles with sufficient power in a high frequency range, so that detection according to the following will be possible at a distance of several meters from the projectile and with a high accuracy.

b) Detection principle

Figure 2:
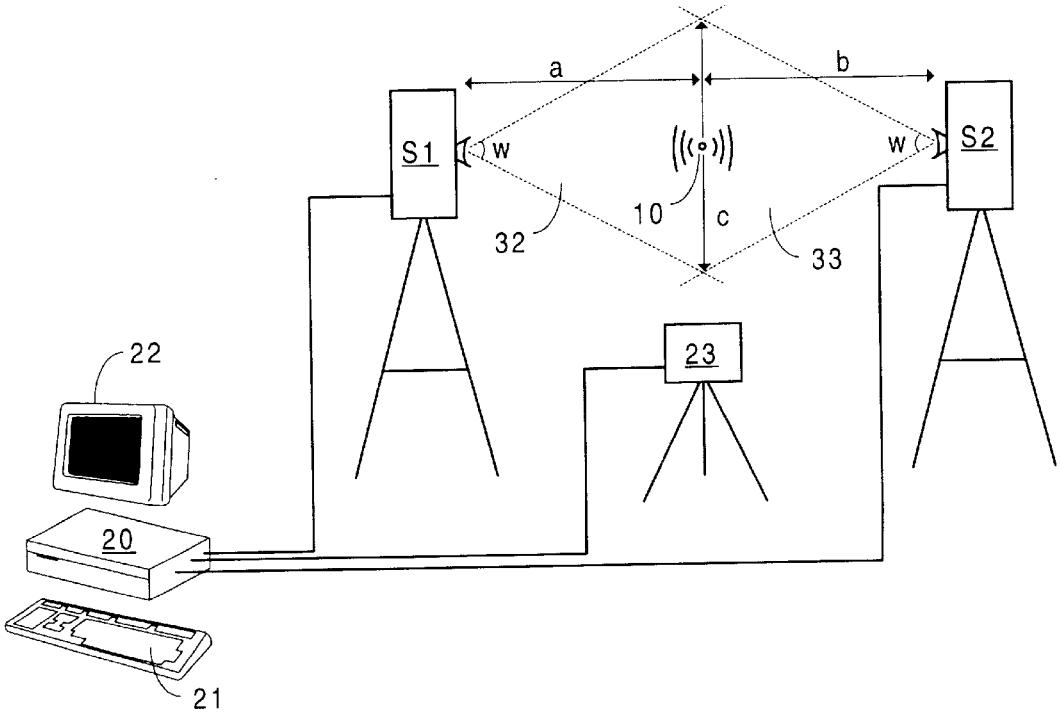
FIG. 2 is a view of a test set-up for measurement of the position of the projectile in one dimension.
Figure 3:
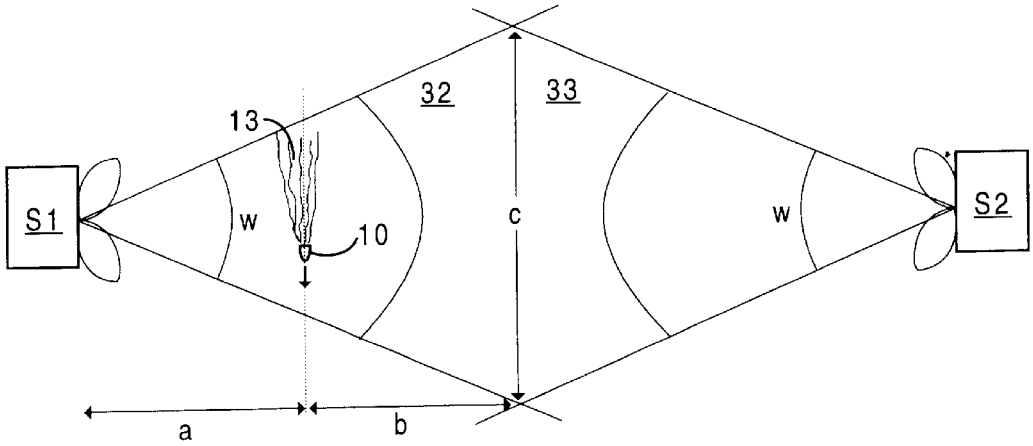
FIG. 3 is a schematic view from above of the test set-up in FIG. 2.

In FIG. 2 and 3 there is shown a test set-up for demonstration of the detection principle according to this invention. A projectile 10 is shown in the figure on its travel to a target panel, which is not shown in FIG. 2 but which is represented by the reference 30 in FIGS. 4 and 5. The projectile 10 is in the following assumed to travel with a speed, which is below the speed of sound, since the advantages of this invention compared to the prior art is thereby expressed more clearly—according to the prior art it would not be possible at all to detect the subsonic projectile, since it has no Mach cone. However, the detection principle works equally well for supersonic projectiles.

Two acoustic sensors S1 and S2, each including electronics suitable for this application for amplification, signal interfacing, etc., are arranged a few meters apart on each side of the direction of travel of the projectile. The sensors are connected to a controller 20, e.g. a conventional personal computer with keyboard 21. It is pointed out here that the functions and the work, which the controller is arranged to accomplish and which is described in more detail below, can be accomplished according to various different hardware and software approaches, which is evident to a professional in this technical field. Furthermore a commercially available projectile velocity meter 23 can be connected to the controller 20. The task of the velocity meter would then be to decide the speed of the projectile 10 in a vicinity of the sensors S1 and S2 and would therefore be placed immediately in front of the sensors. The controller 20 is also connected to a presentation unit 22, which in this case is a conventional computer monitor.

The task of the sensors S1 and S2 is to detect the sound, which according to the analysis above is generated behind the projectile 10, when it passes the sensors through a plane, which is situated at a certain distance from a target panel and which is preferably parallel to a target plane through said target panel. The sensors can be arranged to detect the sound from the monopole, i.e. from a pressure wave concentrically propagating from the projectile wake, and/or the high frequency noise from the dipole and quadrupole contributions. These sounds are possible to detect acoustically for a subsonic projectile as well as for a supersonic projectile according to the results from the analysis above.

In order to detect the sound of the projectile for determining the position of the projectile in a well-defined plane, it is advantageous if the sensors have a directivity, i.e. they have a sensitivity, which is high in the immediate vicinity of the plane and considerably lower outside the plane. A sensor with such a directivity can e.g. be constructed by arranging a number of individual microphone elements, e.g. seven elements, in a so called microphone array, i.e. an arrangement where the individual microphone elements are arranged at predetermined distances to each other, so that the detection contribution from each individual microphone element is constructively amplified with the contributions from the other microphone elements for sound waves arriving in the wanted sensitivity direction (in this case: the detection plane), but is destructively amplified for sound waves arriving in other directions. The contribution from each individual microphone element can furthermore be weighted electronically. The microphone elements can be of a conventional, ceramic type, which utilizes the piezoelectric effects in the element material. To make sensors with directivity by interconnecting a number of individual sensor elements, which together give the desired directivity, is well-known in adjacent technical fields—e.g. in radar technology—and is therefore not described in detail here.

Preferably, the sensors have a sensitivity peak in the supersonic sound range between, say, 30 kHz and 50 kHz. This is advantageous for several reasons. First it is desirable to, as much as possible, eliminate disturbing effects from e.g. firing blasts. Even if such a firing blast has a very broad sound spectrum—even high up in the supersonic sound range—the high frequency sound declines rapidly with distance, and if the sensors are placed far from the firing place (i.e. close to the target) and furthermore operate in the high frequency range, the degree of disturbing effects from the firing blast can be minimised. Furthermore, high frequencies make a high detection resolution possible. High frequency noise is also simpler to screen than low frequency noise.

Every sensor detects, at a certain amplification, sound within a space angle w and has hence its own detecting lobe 32, 33. The relative detection sensitivity has been indicated in the figure for each lobe. To make the measurement of the position possible, both sensors must register sound from the projectile, and hence the measurement can be made inside the rhomboid, which is limited by the cashed lines. The width of the lobe, and hence the distance c in the figure, has been exaggerated for reasons of clarity. In reality, at a detection frequency of, say, 40 kHz and a distance of 4 m between the sensors, the distance c≈200 mm.

The acoustic signals registered by the sensors S1 and S2 are transformed into electrical signals, which are sent to the controller 20. Conventional amplifying and filtering devices can of course be used if needed. The controller 20 is arranged to, from the signals received from the respective sensors, decide a time delay, corresponding to the difference in travel time for the sound/pressure wave of the projectile to the respective sensor, which in turn (since the speed of sound can be taken to be constant within the time and distance intervals in question) is directly representative of the distances a and b from the passage point of the projectile in the measurement plane to the respective sensor S1 and S2, when correction has been made for the speed of the projectile, as measured by the velocity meter 23. If the speed of the projectile can be assumed to be known, the velocity meter 23 need not be used.

Figure 4:
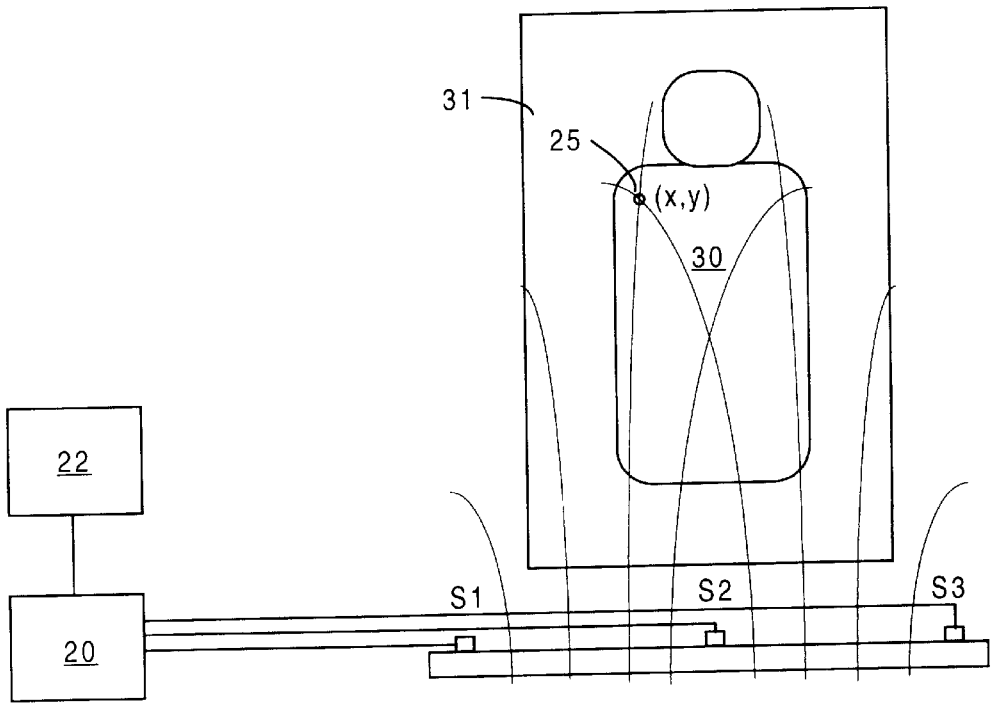
FIG. 4 is a schematic front view of an embodiment of the invention for measuring the position of the projectile in two dimensions.

The time difference can be determined through signal processing in the controller 20 according to some approved method, e.g. by calculating the correlation function $$R(\tau)=\int S1(t)\cdot S2(t-\tau)dt$$

where S1 (t) and S2 (t) are the sensor signals. The correlation results in an estimate of how well the signals match, when one of them is shifted in time relative to the other, and when R(τ) reaches its maximum, the wanted time difference is given by the value of τ. The signal correlation may alternatively be carried out in the frequency domain by suitable transformation, e.g. Fourier transformation, of the electrical signals. When the time differences have been established, the distances a and b can be decided, if the projectile speed and the speed of sound are known. Since, however, it is not always appropriate to assume that the projectile passes exactly in line with the sensors S1 and S2, it is only possible with one pair of sensors as above to decide a range of possible passage points, which together form a hyperbola. Such hyperbolas are indicated in FIG. 4.

By according to the figures using a velocity meter 23 and three acoustic sensors S1, S2 and S3, which all in analogy with the above are operatively connected to the controller 20 and thereby also to the presentation unit 22, it is possible to carry out two measurements in pairs with the help of e.g. S1/S2 and S1/S3, respectively, whereby two hyperbolas for possible passage points are given. The controller is arranged to calculate the crossing of the hyperbolas to get a unique decision of the coordinates (x, y) for the position of the passage of the projectile through the measurement plane. If the distance between the measurement plane, the sensors S1–S3 and the target panel 30 is not too long, the projectile can be assumed to travel in a straight line between the measurement plane and the target panel 30. Therefore, in this case the controller 20 is arranged to project perpendicularly the measured position on a target plane 31 through the target panel 30 and indicate the decided measurement result 25 in a suitable way with the help of the presentation unit 22. The controller 20 can also be arranged to give signals to external equipment, such as a pop-up mechanism or other result-indicating equipment, which depend on the decided measurement result.

c) Preferred embodiment

Figure 5:
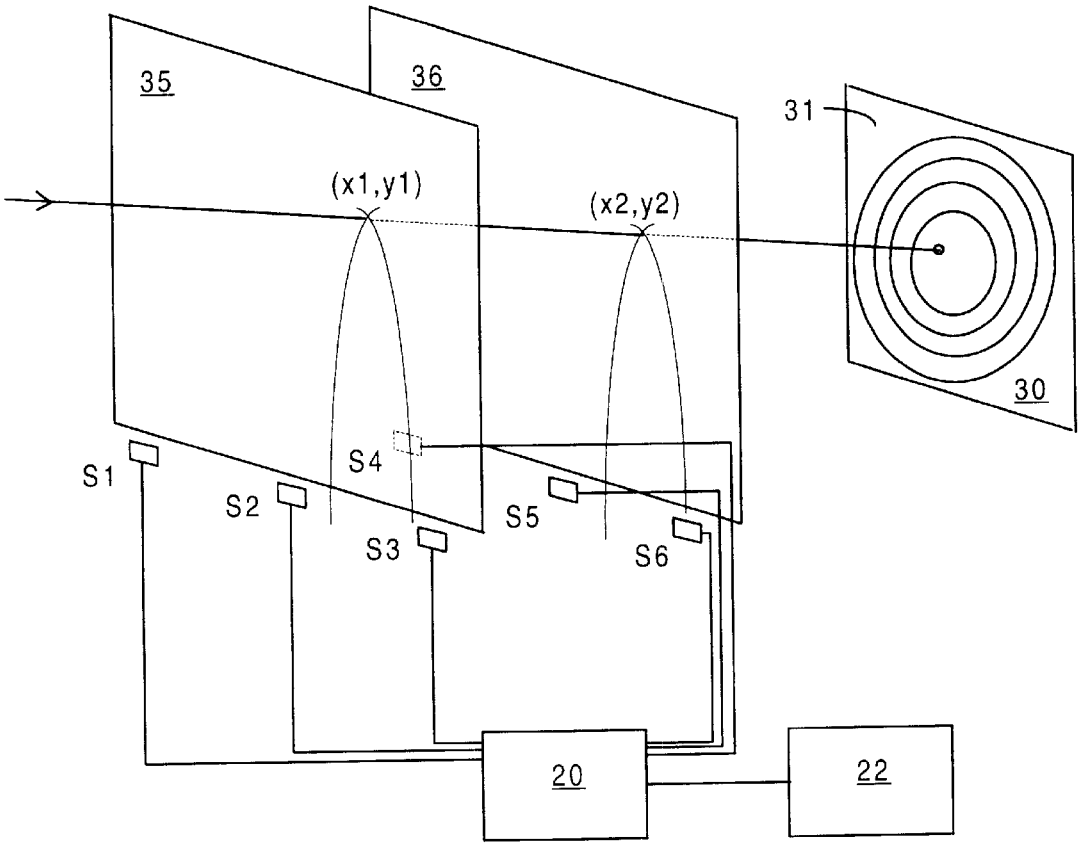
FIG. 5 is a schematic perspective view of a different embodiment of the invention for measuring the position of the projectile in three dimensions.

In FIG. 5 there is shown a preferred embodiment of this invention. Three acoustic sensors S1, S2 and S3 are according to above arranged to measure the position (x1, y1) in a first plane 35 for a passing projectile on its way to the target panel 30. Three additional acoustic sensors S4, S5 and S6 are arranged to measure the corresponding position (x2, y2) in a plane 36 between the first plane 35 and the target plane 31. All acoustic sensors are operatively connected to the controller 20, which in turn is operatively connected to the presentation unit 22. The controller is, in analogy with what has been described above, arranged to combine the measurement signals from each respective sensor to decide the position (x1, y1) and (x2, y2), respectively, for the passage of the projectile through the plane 35 and plane 36, respectively. By this it is possible to detect deviations from a perpendicular projectile passage against the target panel 30, since the controller 20 is arranged to decide the direction of the projectile relative to the normal direction of the target plane by means of the said measured positions. Hence, according to the preferred embodiment of the invention, it is possible with preserved accuracy also to measure the position of such projectiles, which do not arrive perpendicularly to the target panel.

d) Alternative embodiments

According to an alternative embodiment of the invention the system according to FIG. 5 is supplied with means not shown herein for measuring the time it takes between the passages of the projectile through the planes 35 and 36, respectively. With this time and a known distance between the planes the controller is arranged to calculate the speed of the projectile and present it in a suitable way by means of the presentation unit.

According to a second alternative embodiment the sensors S4–S6 in FIG. 5 are made redundant by designing the sensors S1–S3 in such a way, that each of them has two sensitivity lobes instead of one. One lobe is used to measure the projectile sound in the first plane 35, while the other lobe is used for measuring in the second plane 36. In this case the planes 35 and 36 are not parallel to each other. By giving the controller knowledge about the orientation of the two planes relative to each other and relative to the target plane 31, the hit point can be decided by geometrical calculations.

According to a further alternative embodiment, the measuring system uses essentially direction-independent acoustic sensors. Each sensor is in this case preferably made of only one microphone element. The controller 20 is in this case arranged to register the moment, when the time differences between the measurement signals from the respective sensors reach a minimum. At that moment the geometrical distances between the sound generating wake 13 of the projectile and the respective sensors are the shortest, which indicates that the wake is in the intended measurement plane. By using the values of the time differences at that moment the controller may in analogy with the above decide the position of the projectile.

According to another alternative embodiment the measuring system uses at least one microphone, which is directed towards the firing position and which is arranged to register direct sound occuring at firing, and to transmit electrical signals corresponding to the direct sound to the controller 20. The controller 20 is arranged to use these signals to suppress direct sound components in the different measuring signals, thereby reducing the disturbing effects of the direct sound on the measurement result.

According to a further alternative embodiment each acoustic sensor is made of one single microphone element, which is arranged in an acoustically reflective environment, preferably in a bowl-shaped reflector. The microphone element is placed in such a way in the reflector (e.g. in its focal point), that incident acoustic waves cooperate on the microphone element. By pointing the reflector opening towards the desired direction, i.e. in the direction of detection, a highly direction-dependent sensitivity (i.e. a narrow detection lobe) can be achieved. It is also possible, in analogy with the above, to create two detecting lobes by a suitable design of the reflector and by using a preferably wedge-shaped device, which is arranged "above" the microphone element with the task of blocking incident sound waves incoming immediately from the front but allowing sound waves incoming at an angle to pass.

As microphone element also an optical fibre acting as an acoustic detector can be used, which is arranged in an acoustically reflecting and concentrating environment, to achieve direction-dependent sensitivity.

The description above of the invention and its embodiments has been made for exemplifying and not for limiting purposes. The invention can within the context of the enclosed claims be embodied in other ways than those described above.

What is claimed is:

1. A method for determining, without contact, at least one of a position, a direction, and a speed of a projectile in a flight path through a gas toward a target plane plane, said method comprising the steps of:

arranging at least three acoustic sensors in a first plane, said first plane being located to intersect said flight path of said projectile toward said target plane;

detecting, with each of said at least three acoustic sensors, acoustic sound waves generated by said projectile in said flight path toward said target plane through said gas;

said acoustic sound waves detected with each of said three acoustic sensors emanating from at least one of:

a turbulent gas volume extending substantially straight behind said projectile; and a wake or monopole extending substantially straight behind said projectile;

determining time differences for arrival of said acoustic sound waves detected with each of said at least three acoustic sensors;

calculating a position of said projectile in said first plane from said determined time differences; and determining a hit point of said projectile on said target plane from said calculated position of said projectile in said first plane.

2. The method, according to claim 1, wherein:

said hit point of said projectile in said target plane is determined by orthogonally projecting onto said target plane said calculated position of said projectile in said first plane.

3. The method, according to claim 1, said method additionally comprising the further steps of:

calculating a position of said projectile in a second plane;

said second plane being disposed between said first plane and said target plane; and determining, from said calculated position of said projectile in said first plane and from said calculated position of said projectile in said second plane, a deviation of said flight path of said projectile from a direction normal to said target plane.

4. The method, according to claim 3, said method additionally comprising the further steps of:

measuring a travel time of said projectile between said first plane and said second plane; and calculating, from said travel time of said projectile between said first plane and said second plane, a speed of said projectile.

5. The method, according to claim 3, wherein:

said step of calculating said position of said projectile in said first plane is performed using said at least three acoustic sensors; and said step of calculating said position of said projectile in said second plane is also performed using said at least three acoustic sensors.

6. The method, according to claim 1, wherein:

wherein said method is performed to determine said at least one of said position, said direction, and said speed of said projectile when said projectile is traveling at a speed which is substantially lower that the speed of sound in said gas.

7. The method, according to claim 1, wherein:

said projectile comprises a projectile from a small arms weapon.

8. The method, according to claim 1, wherein:

said acoustic sound waves detected with each of said three acoustic sensors has a frequency content; and a majority of said frequency content of said acoustic sound waves detected with each of said three acoustic sensors is in a frequency range which is higher that a frequency range which is substantially normally audible by a human being.

9. An apparatus for determining, without contact, at least one of a position, a direction, and a speed of a projectile in a flight path through a gas toward a target plane, said apparatus comprising:

at least three acoustic sensors arranged in a first plane, said first plane being located to intersect said flight path of said projectile toward said target plane;

means for detecting, with each of said at least three acoustic sensors, acoustic sound waves generated by said projectile in said flight path toward said target plane, said detected acoustic sound waves emanating from at least one of:

a turbulent gas volume extending substantially straight behind said projectile; and a wake or monopole extending substantially straight behind said projectile;

means for determining time differences for arrival of said acoustic sound waves detected with each of said at least three acoustic sensors;

means for calculating a position of said projectile in said first plane from said determined time differences; and means for determining a hit point of said projectile on said target plane from said calculated position of said projectile in said first plane.

10. The apparatus, according to claim 9, said apparatus additionally comprising:

means for calculating a position of said projectile in a second plane;

said second plane being disposed between said first plane and said target plane.

11. The apparatus, according to claim 10, said apparatus additionally comprising:

a controller operatively connected to each of said at least three acoustic sensors; and a presentation unit operatively connected to said controller;

wherein each of said at least three acoustic sensors is disposed to detect a passage of said projectile through each of said first and second planes;

means for causing each of said at least three acoustic sensors to send a signal to said controller upon passage of said projectile through said first and second planes; and wherein said controller comprises:

means for receiving said signals from said at least three acoustic sensors;

means for determining time differences between detection of said passage of said projectile through said first and second planes by said at least three acoustic sensors;

means for calculating, from said determined time differences, a position of said projectile in each of said first and second planes;

means for determining, from said position of said projectile in each of said first and second planes, a hit point of said projectile on said target plane; and means for displaying, on said presentation unit, said determined hit point.

12. The apparatus, according to claim 11, wherein:

each of said at least three acoustic sensors has direction-dependent sensitivity; and each of said at least three acoustic sensors is disposed to detect sound in or within the immediate vicinity of either of said first and second planes.

13. The apparatus, according to claim 12, wherein said controller comprises:

means for calculating, in either the time domain or the frequency domain, a correlation between pairs of said signals from at least some of said at least three acoustic sensors;

means for determining, at maximum signal correlation, a time difference for a signal pair;

means for determining, from said time difference, a number of possible positions for passage of said projectile through each of said first and second planes; and means for combining the results for each of said correlations to determine a unique position for said projectile in each of said first and second planes.

14. The apparatus, according to claim 12, wherein:

each of said at least three acoustic sensors comprises a plurality of microphone elements;

each of said microphone elements being disposed at a specified distance from another of said microphone elements to achieve said direction-dependent sensitivity.

15. The apparatus, according to claim 12, wherein:

each of said at least three acoustic sensors comprises a microphone element;

each of said microphone elements being disposed at a point relative to an acoustically reflecting and concentrating environment to achieve said direction-dependent sensitivity.

16. The apparatus, according to claim 9, wherein said controller comprises:

means for determining a time of travel of said projectile between said first and second planes; and means for determining, from said time of travel of said projectile between said first and second planes, a speed of flight of said projectile.

17. The apparatus, according to claim 9, wherein:

said controller comprises a computer; and said presentation unit comprises a computer display.

18. The apparatus, according to claim 9, wherein:

at least one of said at least three acoustic sensors comprises a distributed and elongated microphone element.

19. The apparatus, according to claim 18, wherein:

said microphone element comprises an optical fiber.

20. The apparatus, according to claim 18, wherein:

said microphone element is disposed in an acoustically reflecting and concentrating environment to achieve said direction-dependent sensitivity.

* * * * *